US007200881B2

(12) United States Patent
Kasagami et al.

(10) Patent No.: US 7,200,881 B2
(45) Date of Patent: Apr. 10, 2007

(54) TRANSFER DEVICE

(75) Inventors: Fumio Kasagami, Osaka (JP); Fumio Hojo, Osaka (JP); Hideaki Hyodo, Osaka (JP)

(73) Assignee: Daihen Corporation, Osaka (JP)

( * ) Notice: Subject to any disclaimer, the term of this patent is extended or adjusted under 35 U.S.C. 154(b) by 6 days.

(21) Appl. No.: 10/966,170

(22) Filed: Sep. 29, 2004

(65) Prior Publication Data

US 2005/0066442 A1 Mar. 31, 2005

(30) Foreign Application Priority Data

Sep. 29, 2003 (JP) ..... 2003-337038

(51) Int. Cl.
*A61G 7/14* (2006.01)

(52) U.S. Cl. ..... 5/81.1 R; 5/81.1 C

(58) Field of Classification Search ..... 5/81.1 R, 5/81.1 C; 198/321, 312, 300, 318
See application file for complete search history.

(56) References Cited

U.S. PATENT DOCUMENTS 3,493,979 A * 2/1970 Crook, Jr. et al. ..... 5/81.1 C
3,947,902 A * 4/1976 Conde et al. ..... 5/81.1 C
4,073,016 A * 2/1978 Koll ..... 5/81.1 C
4,669,137 A * 6/1987 Schnelle et al. ..... 5/81.1 C
4,680,818 A 7/1987 Ooka et al.
5,185,894 A 2/1993 Bastert et al.
5,540,321 A * 7/1996 Foster ..... 198/510.1
6,857,143 B2 * 2/2005 McNulty ..... 5/81.1 C
6,932,209 B2 * 8/2005 Kasagami et al. ..... 198/312
2001/0047543 A1 12/2001 VanSteenburg et al.

FOREIGN PATENT DOCUMENTS

EP 1 348 415 A2 3/2003
JP 47-34477 8/1972

* cited by examiner

*Primary Examiner*—Michael Trettel
(74) *Attorney, Agent, or Firm*—Hamre, Schumann, Mueller & Larson, P.C.

(57) ABSTRACT

A transfer device includes a lower mechanism and an upper mechanism stacked on the lower mechanism. The lower mechanism includes a first endless belt, and the upper mechanism includes a second endless belt. The first and the second endless belts are operable independently of each other for forward and backward circulation. The first endless belt is driven by a first driving unit disposed at one end of the lower mechanism as viewed in the traveling direction of the first endless belt. The second endless belt is driven by a second driving unit disposed at one end of the upper mechanism as viewed in the traveling direction of the second endless belt. A plurality of transfer devices connected in their widthwise direction constitute a transfer device assembly.

23 Claims, 16 Drawing Sheets

TRANSFER DEVICE

BACKGROUND OF THE INVENTION

1. Field of the Invention

The present invention relates to a transfer device which is suitable for use in transferring a patient between a bed and a stretcher with wheels (gurney), for example. The transfer device according to the present invention is also suitable for changing the location of e.g. a piece of wooden furniture without damaging it.

2. Description of the Related Art

In a hospital, nursing facility or the like, a stretcher is used for transporting a patient who cannot walk or has difficulty in walking from a hospital room to an examination room, a treatment room or a bath, for example. Such a stretcher comprises a rest base having a width and a length sufficient for carrying a patient and supported by legs with wheels at a height generally equal to a bed surface. To transfer the patient between the bed and the stretcher, the stretcher is set alongside the bed.

The transfer of the patient is generally performed by lifting the sheets on which the patient lies by a plurality of nurses or care workers. Such work is hard, requiring many hands. Moreover, in transferring a patient with a medical instrument such as an intravenous drip device attached to the patient, the transfer work need be performed very carefully. Further, the work for transferring the patient while keeping the posture of the patient so as not to damage the affected part is very difficult and need be performed carefully.

Conventionally, to facilitate transfer of a patient, various transfer devices have been proposed which utilize motive power to transfer the patient.

For example, in Japanese patent document JP-B-47-34477, a transfer device is proposed in which a transfer mechanism comprising a lower endless conveyor belt and an upper endless conveyor belt is incorporated in a stretcher for advancement onto a bed and retreat onto the stretcher. In transferring a patient from the bed onto the stretcher, with the stretcher set alongside the bed, the lower endless conveyor belt is driven for travel in one direction, and the transfer mechanism is advanced onto the bed in synchronization with the belt travel speed of the lower endless conveyor belt. At this time, the upper endless conveyor belt is caused to travel in the direction opposite from the lower endless conveyor belt. As a result, the transfer mechanism can slip between the bed surface and the patient for placing the patient on the transfer mechanism (upper endless conveyor belt) without causing relative movement between the lower endless conveyor belt and bed surface and between the upper endless conveyor belt and the patient. Thereafter, with the upper endless conveyor belt stopped, the transfer mechanism is retreated onto the stretcher while the lower endless conveyor belt is caused to travel in the direction opposite from the above, whereby the patient can be transferred onto the stretcher.

For the conventional transfer device, however, the transfer mechanism is incorporated in the stretcher. Therefore, when the transfer mechanism retreats, the front edge constantly becomes parallel with the stretcher, and there is a limitation on the advance distance of the transfer mechanism, which gives rise to the following problems.

Firstly, a patient lying as inclined relative to an edge of the bed cannot be properly placed on the transfer mechanism. Specifically, a patient on a bed rarely lies in parallel with an edge of the bed and mostly lies as inclined. Further, depending on the medical condition, the posture of the patient may not be changed easily. In such a case, the transfer device disclosed in the above Patent Document lifts and place the patient obliquely, so that the posture of the patient on the transfer mechanism becomes unstable. Moreover, even on the stretcher, manual work for putting the patient within the width of the stretcher need be performed. As noted above, depending on the medical condition, such easy posture change of the patient may worsen the condition of the patient.

Secondly, a patient lying far from the edge of the bed by a distance larger than the width of the stretcher cannot be dealt with. This is because the transfer mechanism advancing from the stretcher set alongside the bed cannot reach the patient. Although a patient whose condition is not severe may be moved manually on the bed, the transfer device cannot deal with a patient who is in critical condition and whose posture cannot be changed easily.

Moreover, in the transfer device disclosed in the above Patent Document, the transfer mechanism comprising a lower endless conveyor belt and an upper endless conveyor belt vertically combined together is incorporated in the stretcher for advancing and retreating movements. Therefore, the entire apparatus is complicated, and the manufacturing cost is extremely high.

SUMMARY OF THE INVENTION

It is, therefore, an object of the present invention to provide a transfer device which is capable of solving the above problems of the prior art structure, with a simple structure which contributes to cost reduction. The transfer device of the present invention is capable of transferring e.g. a patient to a stretcher regardless of the position and posture of the patient on the bed.

According to a first aspect of the present invention, there is provided a transfer device comprising: a lower mechanism including a first endless belt and a first driving unit for operating the first endless belt; and an upper mechanism including a second endless belt and a second driving unit for operating the second endless belt. The upper mechanism is stacked on the lower mechanism. The first endless belt and the second endless belt are operable independently of each other for forward and backward circulation. The first driving unit is disposed at one end of the lower mechanism as viewed in a traveling direction of the first endless belt, while the second driving unit is disposed at one end of the upper mechanism as viewed in a traveling direction of the second endless belt. The first and the second driving units may be disposed adjacent to each other.

With such an arrangement, in each of the lower and the upper mechanisms, the remaining portion (patient-supporting portion) except for the driving unit can be small in height, which ensures easy and comfortable transfer of a patient from a stretcher to a bed, or a bed to a stretcher, for example.

Preferably, the lower mechanism may include a first rectangular frame and a plurality of first rollers rotatably supported by the first frame, the first endless belt being guided in circulation by these first rollers. Likewise, the upper mechanism may include a second rectangular frame and a plurality of second rollers rotatably supported by the second frame, the second endless belt being guided in circulation by these second rollers.

Preferably, the lower mechanism may include a first supporting section extending horizontally from the first driving unit and having a smaller height than the first driving unit, the first driving unit including a first driving roller held in contact with the first endless belt. Likewise, the upper mechanism may include a second supporting section extending horizontally from the second driving unit and having a smaller height than the second driving unit, the second driving unit including a second driving roller held in contact with the second endless belt.

Preferably, each of the first endless belt and the second endless belt may include a smooth inner surface and an outer surface which is less smooth than the inner surface. In this case, the first driving roller is held in contact with the outer surface of the first endless belt, and the second driving roller is held in contact with the outer surface of the second endless belt. In this manner, the driving force is efficiently transmitted to the endless belt from the driving roller.

Preferably, the first driving unit may be provided with a first tension roller held in contact with the first endless belt, while the second driving unit may be provided with a second tension roller held in contact with the second endless belt. With such an arrangement, the driving force from e.g., a motor can be more efficiently transmitted to the endless belt.

Preferably, each of the first endless belt and the second endless belt may be a timing belt. In this case, the tension rollers may not be necessary.

Preferably, the upper mechanism may include an arm extending beyond the lower mechanism. The arm may have a front end provided with at least one belt-reversing roller for reversing a traveling direction of the second endless belt.

Preferably, the belt-reversing roller may be disposed at a lower position than the first rollers.

Preferably, the arm may be pivotable about a horizontal axis and constantly urged downward.

Preferably, the arm may be provided with a sled covering a lower portion of the belt-reversing roller. With such an arrangement, it is possible to prevent the running endless belt of the upper mechanism from coming into contact with e.g. the sheet on the bed.

Preferably, the front end of the arm may be provided with a plurality of bracket pieces and a rod supported by the bracket pieces. The bracket pieces may be horizontally spaced from each other, and the rod may rotatably support a plurality of belt-reversing rollers for reversing the traveling direction of the second endless belt.

Preferably, the upper mechanism may be detachably attached to the lower mechanism for enabling easier maintenance of the two mechanisms.

According to a second aspect of the present invention, there is provided a transfer device assembly comprising a plurality of transfer devices according to the first aspect of the present invention. In the assembly, the plurality of transfer devices are connected to each other in a widthwise direction, and the first endless belts of the respective transfer devices are operable independently of each other for forward and backward circulation.

Preferably, the lower mechanisms of the respective transfer devices may be connected to each other for providing a lower mechanism assembly to which each of the upper mechanisms is detachably attached.

Preferably, each of the first driving units and the second driving units of the respective transfer devices may be provided with a driving roller held in contact with the endless belt, a motor for rotating the driving roller, a motor driver for operating the motor, and an individual computer for controlling the motor driver. The individual computer may be controlled by a central computer.

Preferably, each of the transfer devices may be provided with a power supply battery.

In the transfer device assembly of the second aspect, each transfer device has its width adjusted in a manner such that the total width of the combined transfer devices (i.e., the transfer device assembly) corresponds to the height of a patient or to the length of the bed.

Preferably, at least one of the transfer devices may be provided with a sensor for detecting an object below the sensor. The output signal from the sensor may be used as a control input signal for the central computer. With such an arrangement, it is possible to automatically stop the traveling assembly when there is no supporting surface ahead of the assembly. Thus, the assembly is prevented from falling off the bed or the stretcher by accident.

Preferably, at least one of the transfer devices may be provided with a speaker controlled by the central computer. Through the speaker, the human operator can be provided with audio information about the operating conditions of the assembly and operational instructions helpful for the operator to properly operate the transfer device assembly.

Other features and advantages of the present invention will become clearer from the detailed description given below with reference to the accompanying drawings.

DETAILED DESCRIPTION OF THE PREFERRED EMBODIMENTS

Reference is now made to the accompanying drawings for describing the preferred embodiments of the present invention.

FIGS. 1–18 show a first embodiment of transfer device assembly according to the present invention.

Figure 1:
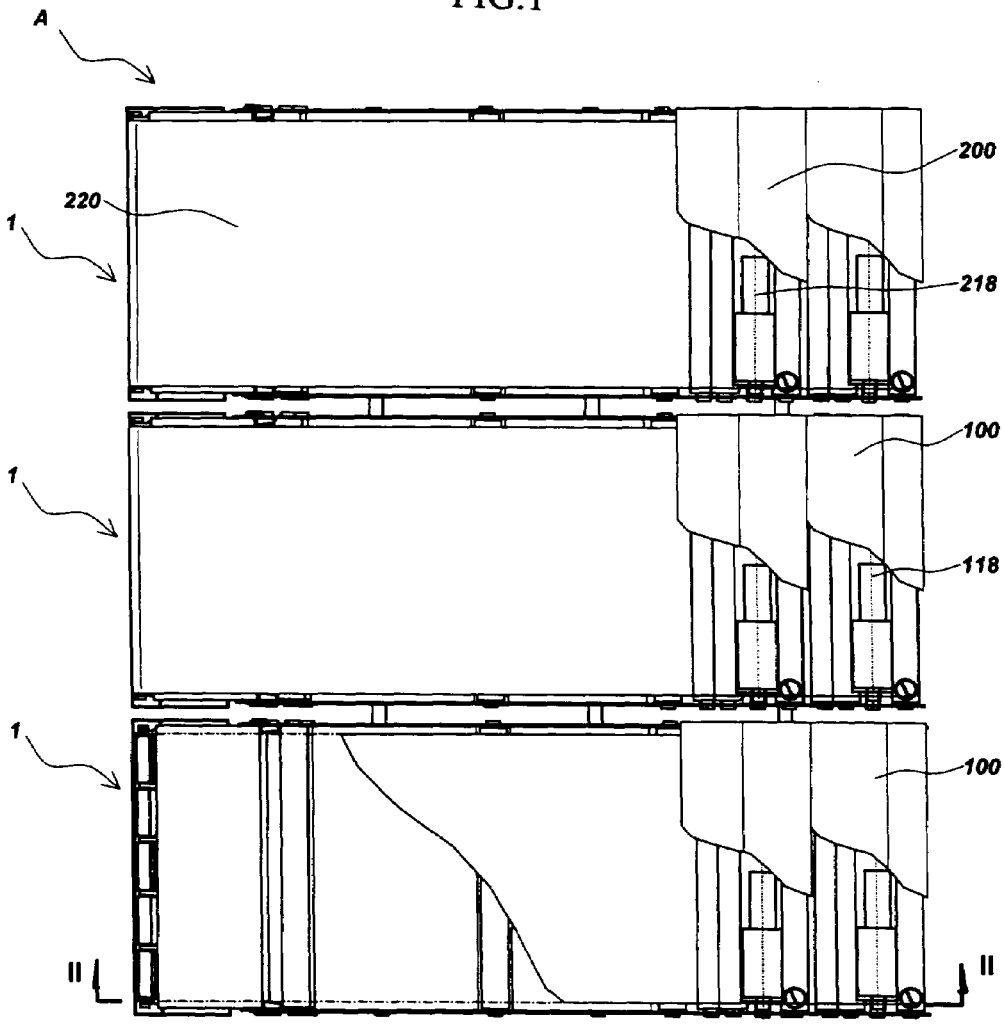
FIG. 1 is a plan view which is partially cut away, showing a transfer device assembly according to a first embodiment of the present invention.
Figure 2:
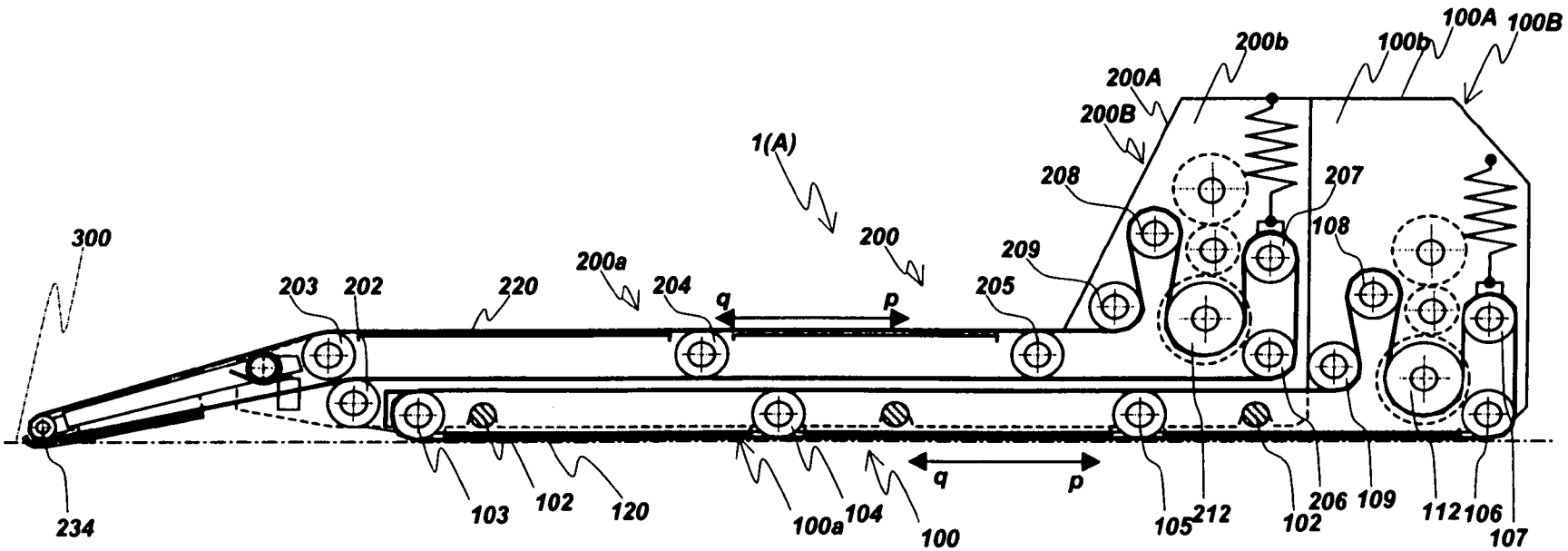
FIG. 2 is a sectional view taken along lines II—II in FIG. 1.
Figure 3:
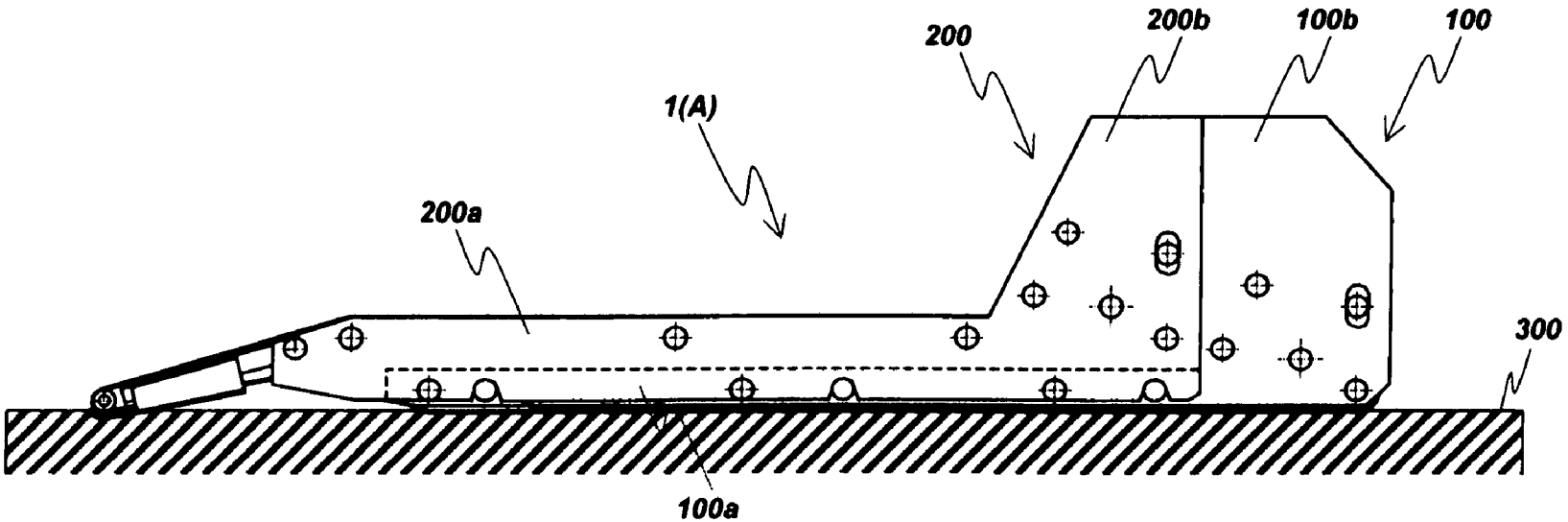
FIG. 3 is a side view of the transfer device assembly shown in FIG. 1.
Figure 4:
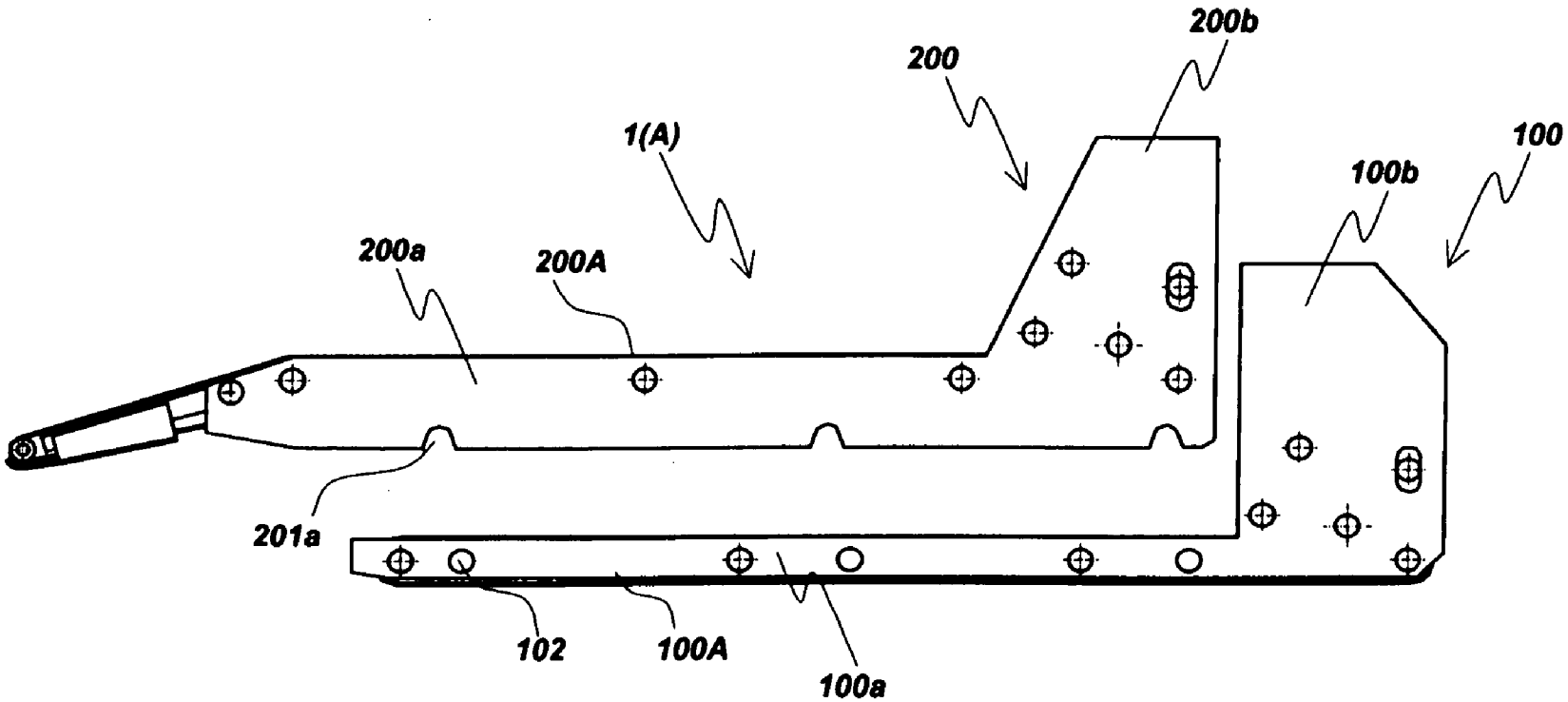
FIG. 4 is a side view showing an assembling manner of the transfer device assembly shown in FIG. 1.

As shown in FIG. 1, the transfer device assembly A comprises a plurality of transfer devices 1 connected together in the widthwise direction. In the illustrated embodiment, three transfer devices are connected together. The width of the transfer device assembly A is so selected as to be sufficient for carrying a patient on a bed, and hence the width of each transfer device 1 is determined depending on the selected width of the assembly. As shown in FIGS. 2–4, each transfer device 1 includes a lower mechanism 100 and an upper mechanism 200 stacked together in the vertical direction.

The upper mechanism 100 and the lower mechanism 200 of each transfer device include endless belts 120, 220, respectively, which are rotatable independently of each other and each of which is rotatable selectively in opposite directions. Driving portions 100B, 200B for driving the endless belts 120 and 220, respectively, are provided in the lower mechanism 100 and the upper mechanism 200 at one end in the belt travel direction. This point will be described in detail below.

As shown in FIGS. 5–8, the lower mechanism 100 includes a frame 100A comprising a pair of side frame components 101 and a plurality of cross frame components 102 bridging the paired side frame components 101. The frame 100A includes a horizontal support 100*a* having a uniform height and a predetermined horizontal length, and a drive housing 100*b* which is provided at an end of the support 100*a* and is larger in height than the support 10*a*. Hereinafter, the support 100*a* side of the frame 100A is defined as the front side, whereas the drive housing 100*b* side of the frame 100A is defined as the rear side. The height of the support 100*a* and the height of the drive housing 100*b* are defined by the vertical dimension of the side frame components 101.

The support 100*a* of the frame 100A is provided with three idle rollers which include a first, a second and a third idle rollers 103, 104 and 105 starting from the front side and each of which is freely rotatable about an axis extending widthwise between the side frame components 101. Preferably, each of the idle rollers 103–105 has a minimum diameter which allows the rotation of the roller without difficulty, and the opposite ends of the idle rollers are supported by the side frame components 101. Each of the idle rollers 103–105 is so supported that the peripheral bottom thereof slightly projects downward from the lower edge of each side frame component 101.

The drive housing 100*b* of the frame 100A is provided with four idle rollers which include a fourth, a fifth, a sixth and a seventh idle rollers 106, 107, 108, 109 each of which is freely rotatable about an axis extending widthwise between the side frame components 101. Among these rollers, the fourth idle roller 106 is arranged at a lower portion on the rear side of the drive housing 100*b* to be generally equal in height to the first, the second and the third idle rollers 103–105, with the peripheral bottom thereof slightly projecting downward from the lower edge of each side frame component 101. The fifth idle roller 107, which is arranged above the fourth idle roller 106, is movable vertically within a predetermined distance, with the opposite ends of its support shaft received in vertically elongated support holes 110 formed in the side frame components 101, and constantly biased upward by springs 111. As will be described later, the fifth idle roller 107 functions as a tension roller. The sixth idle roller 108 is located ahead of the fifth idle roller 107 while being spaced therefrom by a predetermined distance. The seventh idle roller 109 is located ahead of the sixth idle roller 106. The peripheral bottom of the seventh roller 109 is generally flush with the peripheral top of each of the first, the second and the third idle rollers 103–105.

Figure 9:
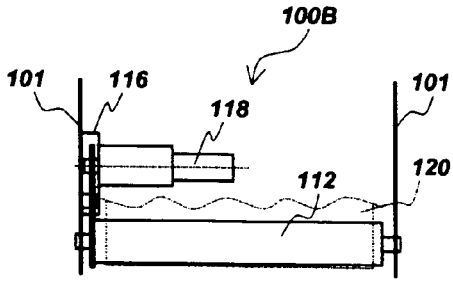
FIG. 9 is a view taken along lines IX—IX in FIG. 8.
Figure 10:
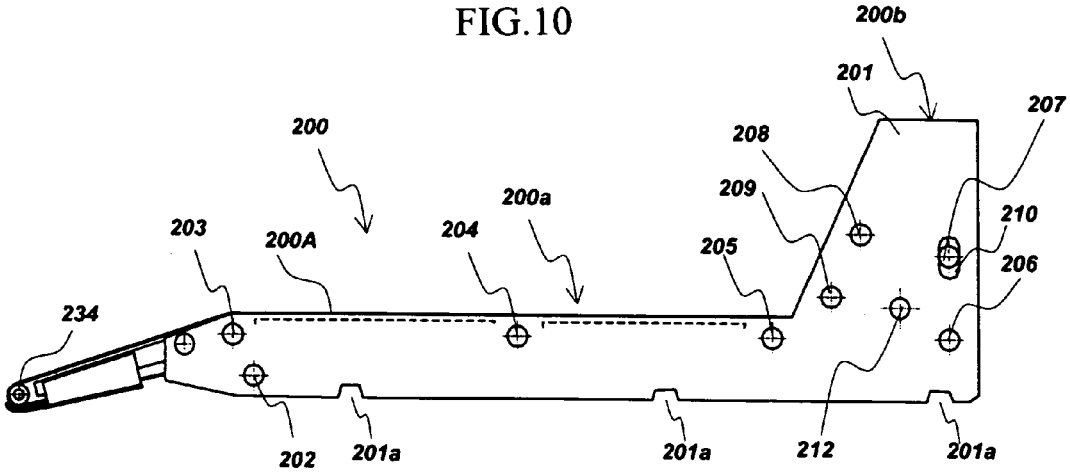
FIG. 10 is a side view of the upper mechanism of the transfer device assembly shown in FIG. 1.
Figure 11:
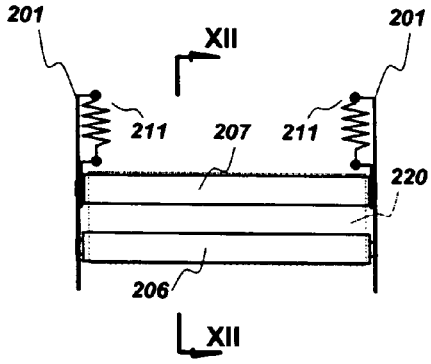
FIG. 11 schematically illustrates the rear surface of the upper mechanism of the transfer device assembly shown in FIG. 1, with components such as the endless belts omitted.

The drive housing 100*b* of the frame 100A is further provided with a drive roller 112 which is arranged below and between the fifth and the sixth idle rollers 107, 108 to be rotatable about an axis extending widthwise between the side frame components 101. As shown in FIG. 9, a motor 118 with a speed reducer (not shown) is provided in the drive housing 100*b* of the frame 100A via a bracket 116. By transmitting the rotation of the motor 118 to the drive roller 112 via a plurality of gears (not shown), the drive roller 112 is driven for rotation selectively in opposite directions.

The endless belt 120, which has a width corresponding to the spacing between the side frame components 101, is wound around the idle rollers 103-109 and the drive roller 112. In the support 100*a* of the frame 10A, the belt 120 is supported by the peripheral top of each of the first, the second, the third idle rollers 103–105 and turns around the first idle roller 103 to change the extending direction. Then, the belt extends under the first, the second, the third idle rollers 103–105. In the drive housing 100*b* of the frame 100A, the belt 120 turns around the fourth idle roller 106 to extend upward, turns around the fifth idle roller (tension roller) 107 to extend downward, and then turns around the drive roller 112 with the outer surface of the belt held in contact with the drive roller. After passing around the drive roller 112, the belt turns around the sixth idle roller 108 and the seventh idle roller 109 and then extends into the support 100*a* of the frame 100. In this way, by rotating the drive roller 112 selectively in opposite directions, the endless belt 120 circulates along the above-described travel path selectively in either one of the two opposite directions. In traveling under the first, the second, the third, the fourth idle rollers 103–106, the inner surface of the belt 120 is slidably supported by back-up plates 119 (FIG. 8) provided to bridge between the side frame components 101.

Preferably, the inner surface of the endless belt 120 is treated with e.g. ethylene fluoride resin for enabling smooth sliding movement, whereas the outer surface of the endless belt is treated to become irregular to provide slip resistance. In the support 100*a* of the frame 100A, the belt 120 contacts both of the peripheral top and peripheral bottom of each of the first, the second and the third idle rollers 103–105. The above-described treatment of the inner surface of the belt 120 prevents the traveling of the belt from being hindered due to the resistance by contact with the idle rollers 103–105. On the other hand, since the outer surface of the belt 120 is made slip-resistant with respect to the drive roller 112, the rotation force of the roller 112 is efficiently transmitted to the belt 120, whereby the belt 120 is driven without slipping. As described later, the slip-resistant outer surface of the belt 120 comes into contact with a bed surface 300, for example, the traveling force of the lower mechanism 100 by the rotation of the belt 120 is efficiently transmitted to the bed surface 300.

Figure 5:
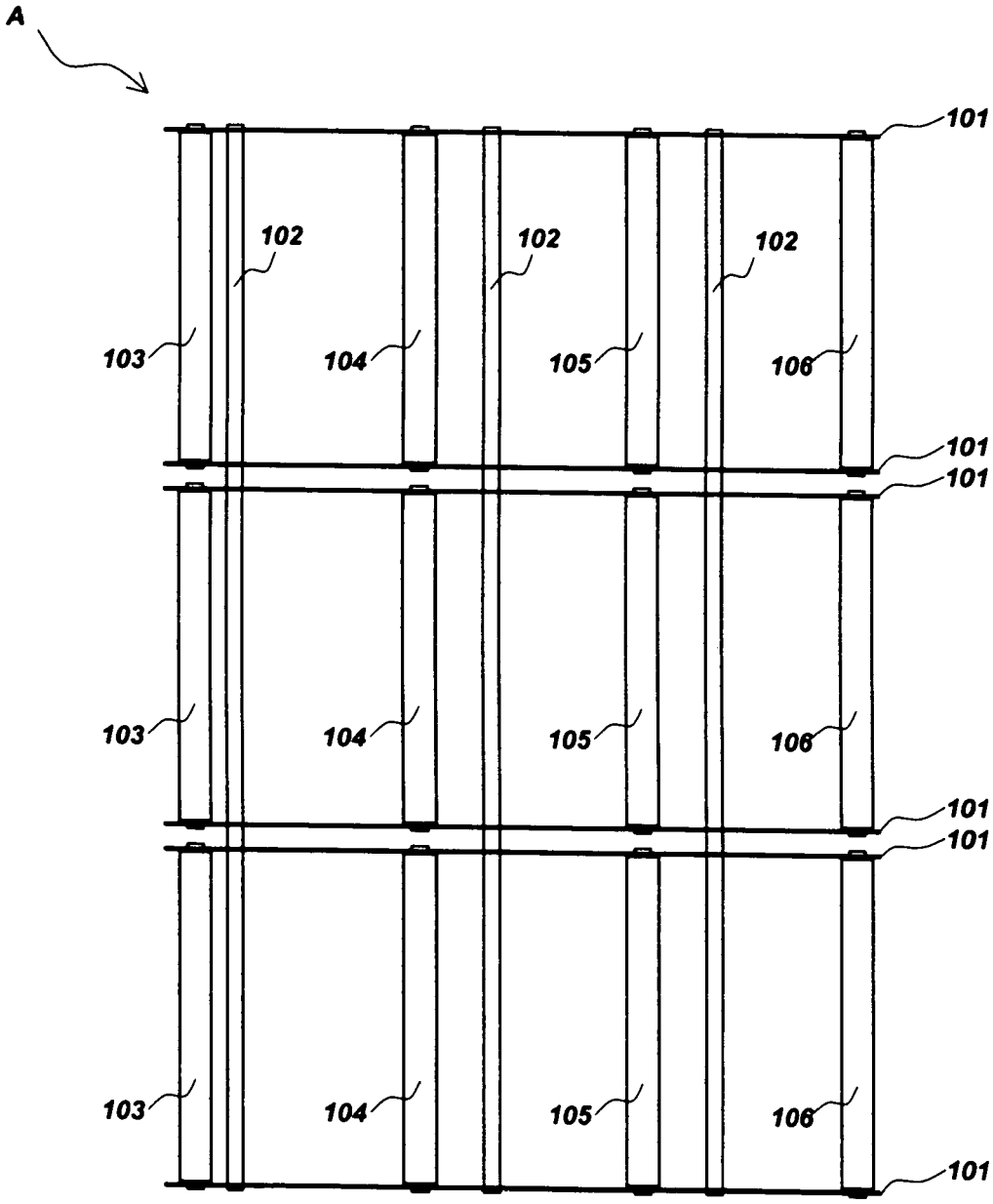
FIG. 5 is a bottom view showing the frame of a lower mechanism of the transfer device shown in FIG. 1, with the back-up plates omitted.
Figure 6:
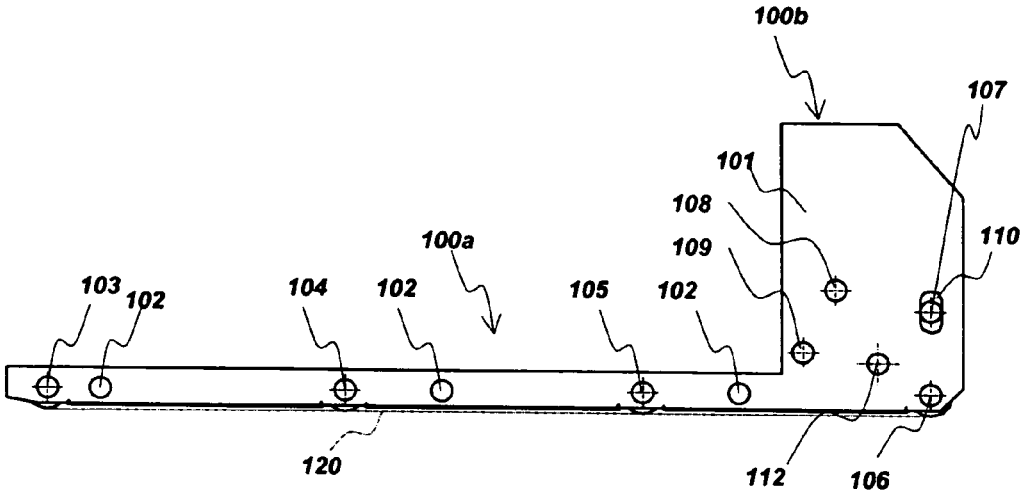
FIG. 6 is a side view of the lower mechanism of the transfer device assembly shown in FIG. 1.
Figure 7:
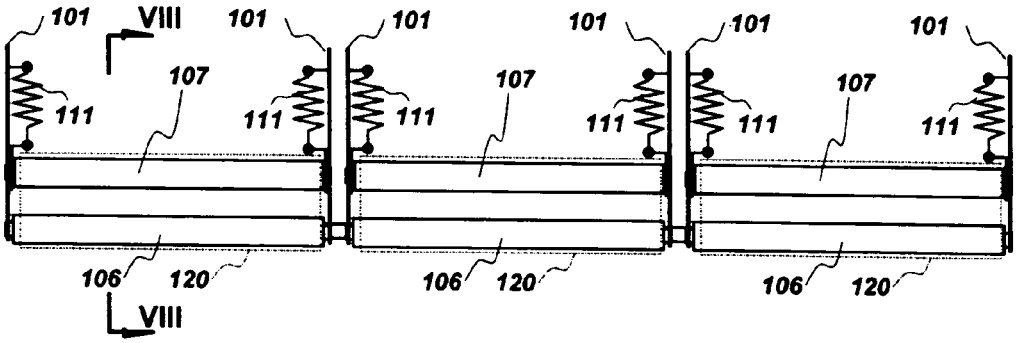
FIG. 7 schematically illustrates the rear surface of the lower mechanisms of the transfer device assembly shown in FIG. 1, with components such as the endless belts omitted.
Figure 8:
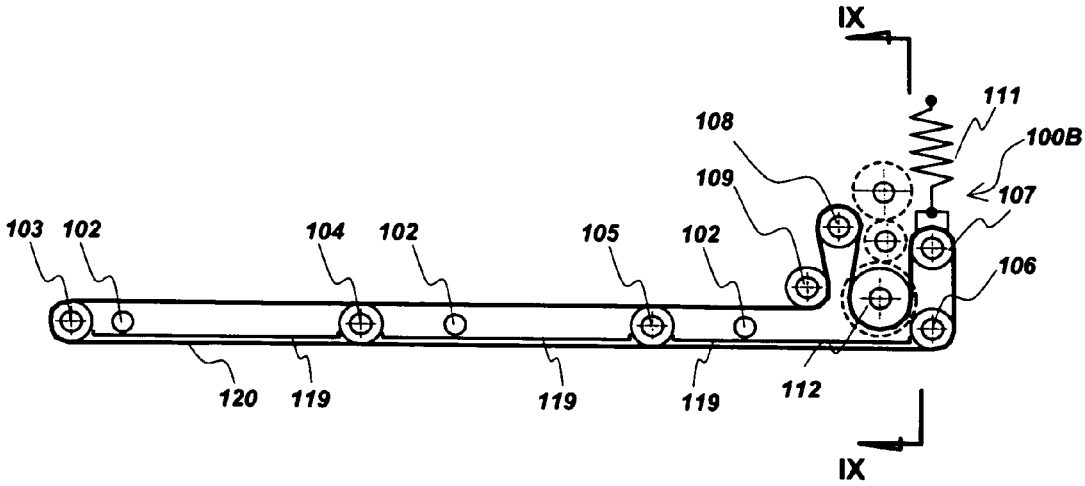
FIG. 8 is a sectional view taken along lines VIII—VIII in FIG. 7.

As shown in FIG. 5, each cross frame component 102 extends through the side frame components 101 of the respective lower mechanisms 100. Thus, the three lower mechanisms 100 are connected widthwise to each other as one integral assembly.

The upper mechanism 200 has a structure which is similar to the above-described structure of the lower mechanism 100. Specifically, as shown in FIGS. 10–13, the upper mechanism 200 includes a frame 200A comprising a pair of side frame components 201 and a plurality of non-illustrated cross frame components bridging the paired side frame components 201. The frame 200A includes a support 200*a* having a uniform height and a predetermined horizontal length, and a drive housing 200*b* which is provided at an end of the support 200*a* and is larger in height than the support 200*a*. The distance between the side frame components 201 of the upper mechanism 200 corresponds to the distance between the outer surfaces of the side frame components 101 of the lower mechanism 100. Each side frame component 201 of the upper mechanism 200 has a lower edge formed with recesses or cutouts 201*a*. The recesses 201*a* correspond in position to the cross frame components 102 of the lower frame 100A so that each recess 201*a* can come into engagement with the corresponding one of the cross frame components 102 from above. As shown in FIGS. 2–4, the upper mechanism 200 is stacked on and combined with the lower mechanism 100 with the recesses 201*a* held in engagement with the cross frame components 102. As shown in FIGS. 2 and 3, when the upper mechanism 200 is combined with the lower mechanism 100, the drive housing 200*b* of the frame 200A of the upper mechanism 200 is located in front of the drive housing 100*b* of the frame 100A of the lower mechanism 100. The support 200*a* of the frame 200A of the upper mechanism 200 projects forward beyond the front end of the support 100*a* of the frame 100A of the lower mechanism 100.

The support 200*a* of the frame 200A of the upper mechanism 200 is provided with three idle rollers which are a first, a second and a third idle rollers 203, 204, 205 starting from the front side and each of which is freely rotatable about an axis extending widthwise between the side frame components 201. Each of the idle rollers 203–205 has a diameter which is as small as possible and generally equal to those of the first, the second, the third idle rollers 103–105 of the lower mechanism 100. The height of each of the first, the second and the third idle rollers 203–205 is so set that the peripheral top of the roller becomes flush with the upper edge of the support 200*a* of the side frame components 201. The lower edge of each of the first, the second and the third rollers 203–205 is located above and spaced from the belt 120 traveling over the first, the second and the third idle rollers 103–105 of the lower mechanism 100. With such an arrangement, as described later, an endless belt 220 traveling around the rollers in the upper mechanism 200 is prevented from coming into contact with the endless belt 120 of the lower mechanism 100.

In the drive housing 200*b* of the frame 200A, four idle rollers, i.e. a fourth, a fifth, a sixth and a seventh idle rollers 206–209 are provided in a manner similar to that of the four idle rollers 106–109 of the lower mechanism 100. For instance, each of the rollers 206–209 is freely rotatable about an axis extending widthwise between the side frame components 201. The fifth idle roller 207 is vertically movable by a predetermined distance. Specifically, the idle roller 207 is supported by a horizontal shaft. This shaft has two ends (opposite to each other) each of which is received in a vertically elongated hole 210 formed in the side frame component 201. At the respective ends, the support shaft is constantly biased upward by springs 211, so that the idle roller 207 functions as a tension roller.

Figure 13:
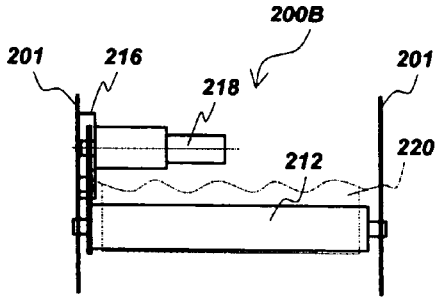
FIG. 13 is a sectional view taken along lines XIII—XIII in FIG. 12.

In the upper mechanism 200 again, the drive housing 200*b* of the frame 200A is provided with a drive roller 212 arranged between and below the fifth and the sixth idle rollers 207–208 to be rotatable about an axis extending widthwise between the side frame components 201. Similarly to the lower mechanism 100, a motor 218 with a speed reducer is provided in the drive housing 200*b* of the frame 200A via a bracket 216 (FIG. 13). By transmitting the rotation of the motor 218 to the drive roller 212 via a plurality of gears, the drive roller 212 is driven for rotation in any one of the two opposite directions.

Figure 12:
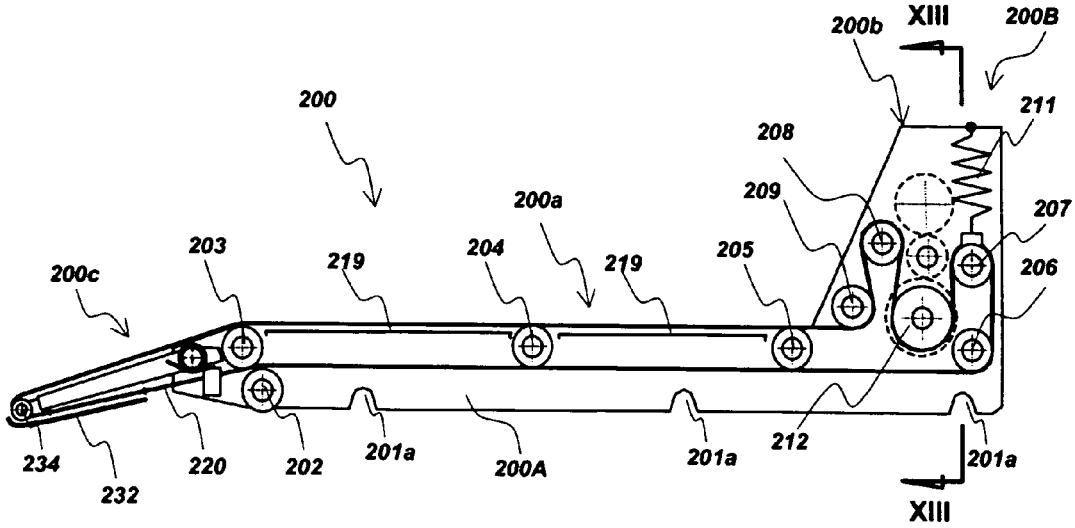
FIG. 12 is a sectional view taken along lines XII—XII in FIG. 11.
Figure 14:
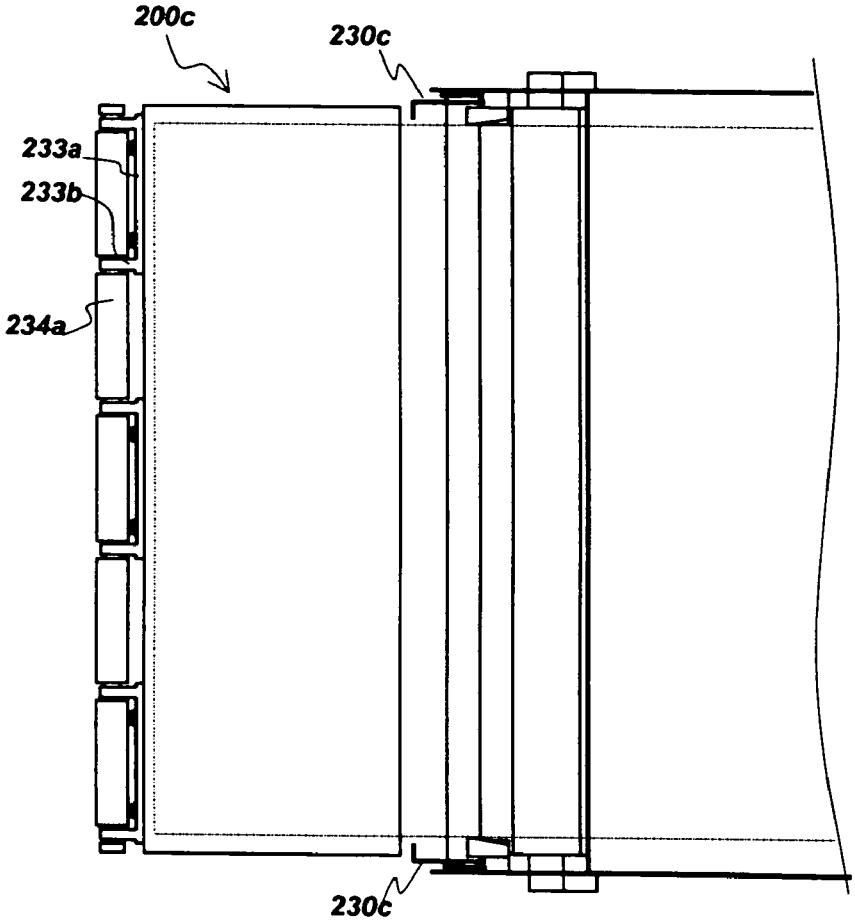
FIG. 14 is an enlarged plan view showing a pivot arm of the upper mechanism.
Figure 15:
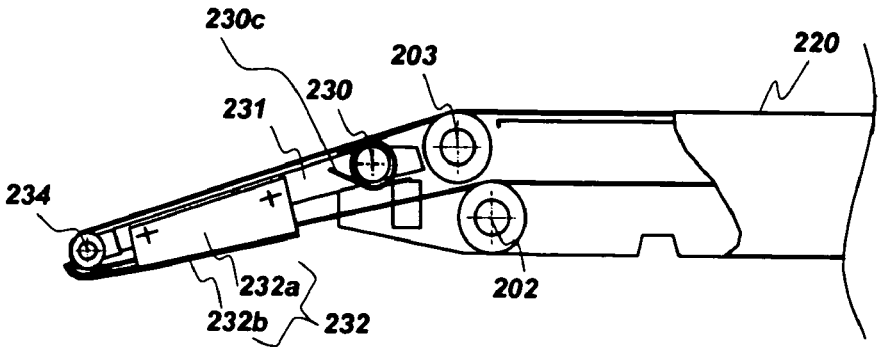
FIG. 15 is a sectional side view, partially in section, showing the pivot arm of the upper mechanism.

As shown in FIGS. 12, 14–15, the support 200*a* of the frame 200A of the upper mechanism 200 has a front end provided with a pivot arm 200*c* which is vertically pivotable about a widthwise-extending shaft 230. The pivot arm 200*c* is constantly biased downward by torsion springs 230*c*. The pivot arm 200*c* has a front end provided with a rotatable, belt-reversing roller 234 having a relatively small diameter.

As shown in FIGS. 14 and 15, the pivot arm 200*c* includes a plate-like arm member 231 pivotable about the shaft 230. The arm member 231 has a front surface to which a plurality of rod-supporting projections ("bracket pieces") 233*b* are attached. Each projection 233*b* extends forward from the front surface of the arm member 231. In the illustrated example, use is made of six projections 233*b* divided into three identical units (each including two projections 233*b*). In each unit, the two projections 233*b* are connected to each other by a base plate 233*a* extending between them (the paired projections 233*b* and the base plate 233*a* constitutes one bracket). The base plate 233*a* is fixed to the front surface of the arm member 231 by bolts, for example.

Figure 16:
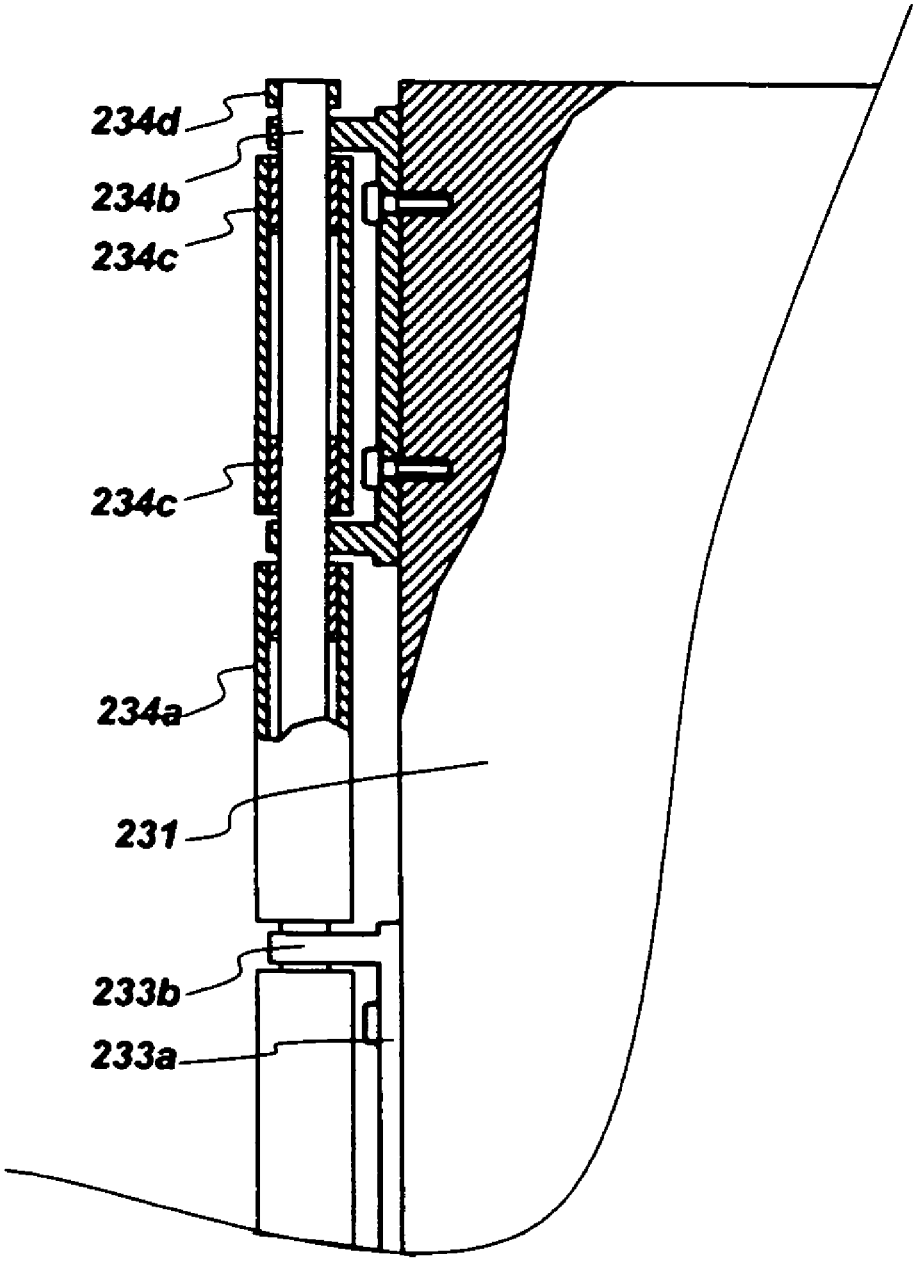
FIG. 16 is an enlarged plan view, partially in section, showing details of the support structure of a belt reversing roller in the pivot arm of the upper mechanism.

As shown in FIG. 16, the bracket pieces 233*b* support a rod 234*b* extending widthwise of the frame 200A. The rod 234*b* is provided with a plurality of small-diameter rollers 234*a* each located between adjacent ones of the bracket pieces 233*b* and rotatably fitted around the rod. In this manner, the rollers 234*a* spaced widthwise of the frame 200A constitute a belt reversing roller assembly 234. With such an arrangement, each roller 234*a* has a relatively small length. Thus, even when the rod 234*b* has a relatively small diameter (and accordingly each roller 234*a* has a small outer diameter, say, 5 mm), the roller 234*a* can properly rotate on the rod 234*b* without sticking to the rod or causing stick-slip movement, for example. Preferably, the roller 234*a* may comprise a cylindrical member and oilless bushes 234*c* fitted at the two ends of the cylindrical member for reducing friction.

The support 200*a* of the frame 200A of the upper mechanism 200 is provided with a plurality of back-up plates 219 for slidably supporting the inner surface of the endless belt 220. The back-up plates 219 are disposed between the first idle roller 203 and the second idle roller 204, and between the second idle roller 204 and the third idle roller 205. The support 200*a* is also provided with a guide roller 202 located below the first idle roller 203 for supporting the endless belt 220 from below. Further, the pivot arm 200*c* is provided with a sled 232 covering the lower side of the roller assembly 234. The sled 232 comprises two brackets 232*a* and a sled plate 232*b*. The brackets 232*a* are connected to the right and left sides of the arm member 231, while the sled plate 232*b* bridges between the brackets 232*a* and are connected to them. The sled plate 232*b*, extending forward under the arm member 231, has a front end which is located under the roller assembly 234 and spaced therefrom by a predetermined distance. This front end is curved upward (downwardly convex) to follow the contour of the roller assembly 234.

The endless belt 220 has a width corresponding to the dimension between the side frame components 201. As shown in FIGS. 1, 2 and 12, the endless belt 220 is wound around the idle rollers 203–209, the drive roller 212, the roller assembly 234 and the guide roller 202. In the support 200*a* of the frame 200A and the pivot arm 200*c*, the belt 220 is supported by the peripheral top of the idle rollers 203–205 and caused to turn around by the roller assembly 234, so that the travel direction of the belt 220 is reversed. Then, the belt 220 is supported by the guide roller 202 from below and extends under the peripheral bottom of the idle rollers 203–205. In the drive housing 200*b* of the frame 200A, the belt 220 turns around the fourth idle roller 206 to extends upward, turns around the fifth idle roller (tension roller) 207 to travel downward. Then, the belt 220 turns around the drive roller 212 with the outer surface of the belt held in contact with the drive roller. After separating from the drive roller 212, the belt 220 turns around the sixth and seventh idle rollers 208, 209 and then transferred toward the support 200*a* of the frame 200. With such an arrangement, upon rotation of the drive roller 212 in a selected one of the forward and backward directions, the endless belt 220 is caused to travel along the above-described travel path in the desired direction. In traveling along the upper surface of the pivot arm 200*c*, the belt 220 is slidably supported by the arm member 231. Further, in travelling along the upper surface of the support 200*a* of the frame 200A, the belt 220 is slidably supported by the back-up plates 219. Under the roller assembly 234, the endless belt 220 is protectively covered by the sled 232.

Preferably, the endless belt 220 of the upper mechanism 200 also has its inner surface treated with e.g. ethylene fluoride resin for enabling smooth sliding movement and has its outer surface treated to become irregular to prevent slipping. In the support 200*a* of the frame 200A, the belt 220 contacts both of the peripheral tops and peripheral bottoms of the first, the second and the third idle rollers 203–205. The above smoothing treatment of the inner surface of the belt 220 prevents improper traveling of the belt. On the other hand, since the anti-slipping outer surface of the belt 220 coming into contact with the drive roller 212 ensures that the rotational force of the roller 212 is efficiently transmitted to the belt 220, whereby the belt 220 can travel without slipping. Accordingly, as described in detail below, a patient can be moved onto the support 200*a* of the frame 200A of the upper mechanism 200 without causing the slipping of the belt 220.

According to the present invention, as noted above, the tree lower mechanism 100 combined by cross frame components 102 constitute a lower mechanism assembly, upon which the above-described upper mechanisms 200 are stacked, one upper mechanism 200 for one lower mechanism 100. This provides a transfer device assembly A comprising three transfer devices 1 connected to each other in their widthwise direction.

Figure 17:
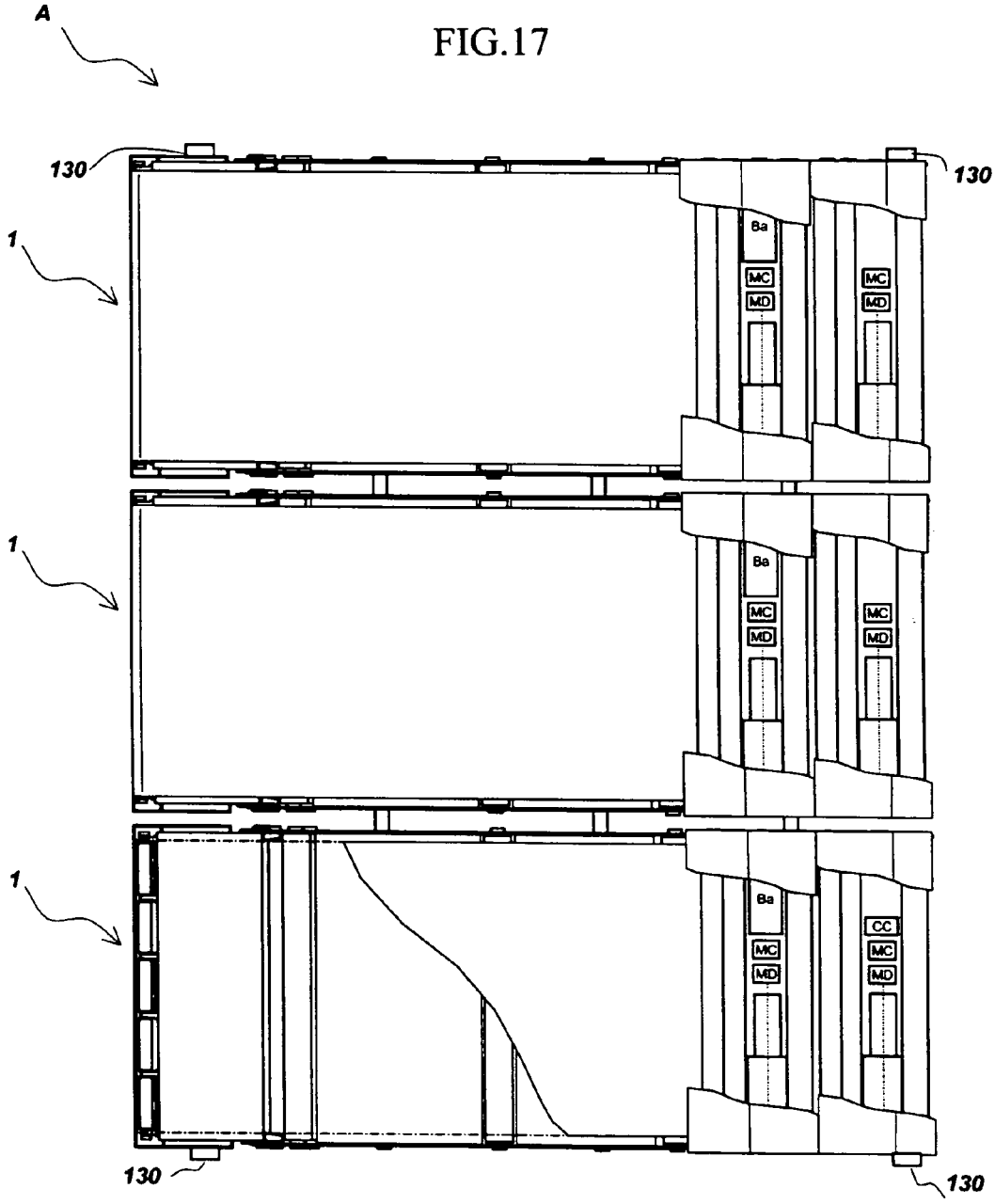
FIG. 17 is a plan view, partially in section, showing respective driving portions of the upper mechanisms and the lower mechanisms.
Figure 18:
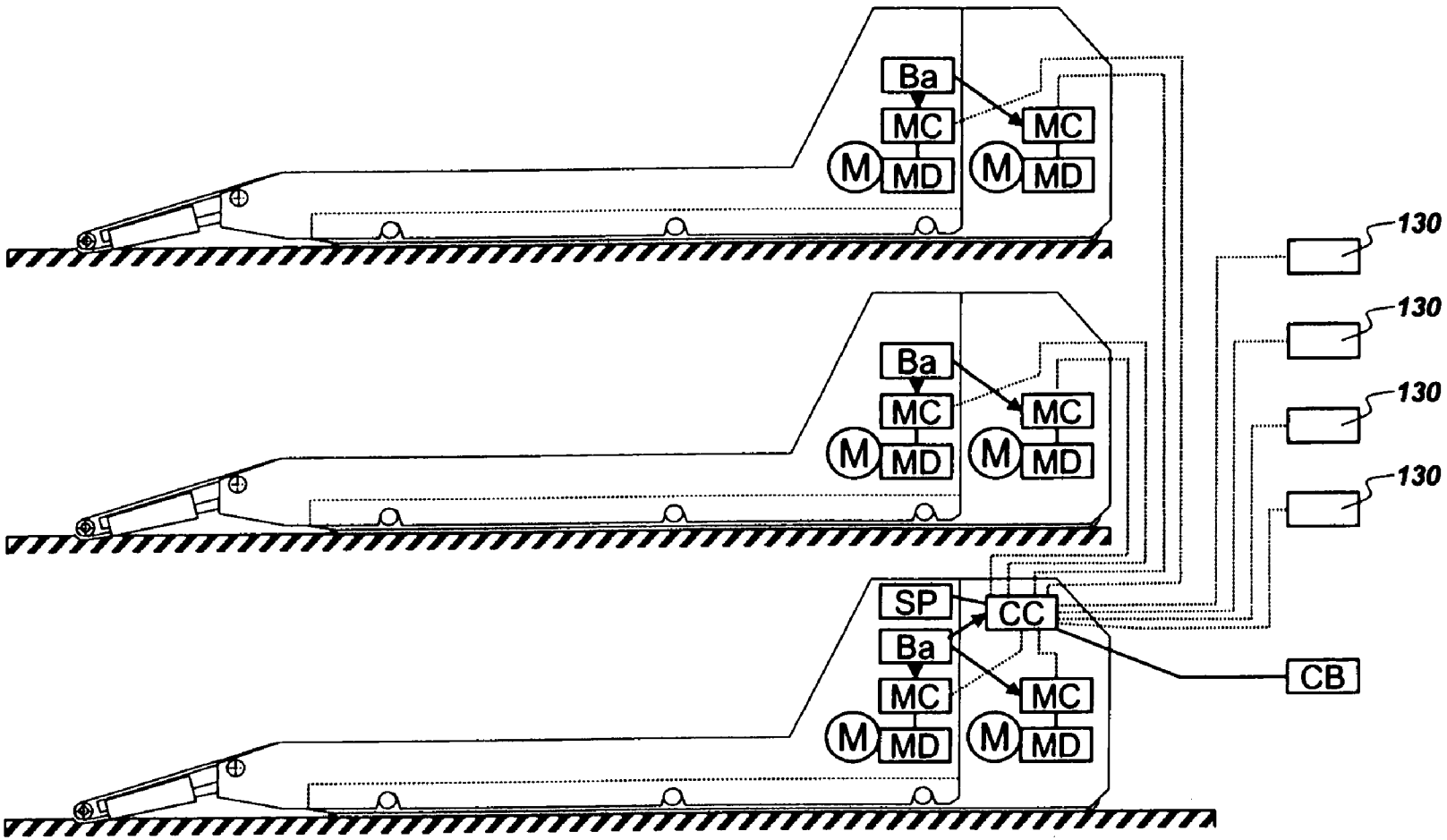
FIG. 18 schematically illustrates the electrical system of the transfer device assembly shown in FIG. 1.

As noted above, the lower mechanism 100 and the upper mechanism 200 of each transfer device 1 are provided with individual driving portions 100B and 200B respectively including motors 118 and 218 with speed reducers. As shown in FIGS. 17 and 18, each of the motors 118, 218 with a speed reducer is provided with a motor driver MD which is controlled by a micro computer MC connected thereto. The upper mechanism 200 of each transfer device 1 has a battery Ba which supplies electric power to the lower mechanism 100 and the upper mechanism 200 of the transfer device 1. A central computer CC is mounted in a selected one of the three transfer devices 1. The micro computers MC mounted in the lower mechanism 100 and the upper mechanism 200 of each transfer device 1 are controlled by the central computer CC. The central computer CC receives instructions of a human operator through a control box CB arranged at an appropriate portion of the transfer device assembly A. Preferably, each of the central computer CC and micro computers MC comprises a one-chip computer.

As noted above, the transfer device assembly A is so designed as to reduce the travel resistance of the endless belts 120, 220 in each transfer device 1 and also to efficiently transmit the driving force to the belts 120, 20. Therefore, a motor with small output can be used as the motors 118, 218 of the driving portions 100B, 200B of the lower mechanism 100 and the upper mechanism 200 in each transfer device 1.

As shown in FIG. 17, a plurality of object detection sensors 130 for optically detecting the presence (and absence) of an object below (the floor or any other supporting surface, for example) may be provided at the four corners of the transfer device assembly A. The object detection sensor 130 outputs an ON signal when an object exists within a predetermined vertical range under the sensor, while it outputs an OFF signal when there is no such object. The output signals from the object detection sensor 130 are utilized as part of input signals for the control by the central computer CC. With such an arrangement, the transfer device assembly A can be designed to automatically stop in the traveling when there is an OFF signal output, which means that no surface for supporting the assembly A is present ahead. In other words, the detection sensors 130 and the related system serve as fall prevention means for the assembly A.

Further, as shown in FIG. 18, the transfer device assembly A may be provided with a speaker SP controlled by the central computer CC. With such an arrangement, the human operator can hear, for example, the explanation about the current operation of the apparatus or instructions the operator needs to follow. For example, by notifying operational instructions by voice, a nurse or a care worker in operating the transfer device assembly can notice that some erroneous operation is being performed. This enables him or her to swiftly take care of the trouble (stop the operation, for example), and therefore the safety can be enhanced. As another example, when the object detection sensor detects the absence of an object below (the supporting surface) and the apparatus is automatically stopped, the reason for the halt can be notified through the speaker SP.

In the transfer device assembly A, the entire apparatus can be advanced or retreated by driving the endless belt 120 of each lower mechanism 100. Further, since the lower mechanism 100 and the upper mechanism 200 of each transfer device 1 have independent driving portions 100B and 200B, operations such as "straight traveling", "circular traveling", "turning at a fixed position (pivoting)" and "patient-carried turning" can be performed.

Specifically, for the "straight traveling" mode, all of the endless belts 120 of the lower mechanisms 100 of the three transfer devices 1 are operated in the same direction at the same speed. In this "straight travelling", selection can be made between a first mode in which the endless belts 220 of the upper mechanisms 200 rotate in the opposite direction from the endless belts 120 of the lower mechanisms 100 and a second mode in which the endless belts 220 of the upper mechanisms 200 are kept stationary.

For the "circular traveling", the endless belt 120 of the left-side lower mechanism 100 and the endless belt 120 of the right-side lower mechanism 100 are operated at different speeds. The endless belt 120 of the lower mechanism 100 in the middle is operated at the average speed of the rotation speeds of the endless belts 120 of the left and the right lower mechanisms 100. In this case, the endless belt 220 of each upper mechanism 200 may be kept stationary.

In the "turning at a fixed position", the endless belt 120 of the left-side lower mechanism 100 and the endless belt 120 of the right-side lower mechanism 100 are operated in the opposite directions, whereas the endless belt 120 of the center lower mechanism 100 is kept stationary. In this case, the endless belt 220 of each upper mechanism 200 may be kept stationary.

In the "patient-carried turning", the endless belt 120 of the left-side upper mechanism 200 and the endless belt 220 of the right-side upper mechanism 200 are operated in the opposite directions, whereas the endless belt of the upper mechanism 200 in the middle is kept stationary. In this case, the endless belt 120 of each lower mechanism 100 may be kept stationary.

The control box CB may be provided with an ON/OFF switch as well as switches for selecting the above-described mode such as "straight traveling" "circular traveling" "turning at a fixed position" or "patient-carried turning" and for selecting the direction and the speed in each mode. In accordance with such an operation input, the central computer CC transmits instructions to each micro computer MC, whereby each motor 118, 218 with a speed reducer is controlled and driven to perform the intended operation. As noted above, signals from the object detection sensors 130 are also sent to the central computer CC so that the driving of the endless belts 120 of all the lower mechanisms 100 is stopped when any one of the object detection sensors 130 detects the absence of an object below and outputs an OFF signal.

Next, the basic operation of the transfer device assembly A will be described below with reference to FIG. 2, for example. The transfer device assembly A is placed on a stretcher or on a bed. Therefore, the lower traveling portion of the endless belt 120 of the lower mechanism 100 comes into contact with the bed surface 300, for example. Since the support 200*a* of the upper mechanism 200 projects forward of the support 100*a* of the lower mechanism 100 and the pivot arm 200*c* is resiliently biased downward, the sled 232 at the front end of the pivot arm 200*c* also resiliently contacts the bed surface 300. When the endless belt 120 of the lower mechanism 100 is rotated selectively in opposite directions, the endless belt 120 moves like a caterpillar, whereby the transfer device assembly A as a whole advances or retreats. At this time, the pivot arm 200*c* slides over the bed surface 300 via the sled 232 so that the endless belt 220 turning around the roller assembly 234 does not come into direct contact with the bed surface 300. Therefore, the movement of the endless belt 220 of the upper mechanism 200 does not hinder the advance or retreat of the transfer device assembly A nor roll up the sheets or clothes of the patient.

In the case where the endless belt 120 of the lower mechanism 100 is driven for rotation (in the direction of the arrow p in FIG. 2) for advancing the apparatus, when the endless belt 220 of the upper mechanism 200 is rotated at the same speed but in the opposite direction from the endless belt 120 of the lower mechanism 100, the movement of the endless belt 220 traveling along the upper surface of the support 200*a* of the upper mechanism 200 relative to the bed surface 300 does not occur. Therefore, the support 200*a* of the upper mechanism 200 of the transfer device assembly A can slip between the bed surface 300 and the patient lying on the bed without putting stress on the patient. This means that the patient on the bed can be smoothly transferred onto the support 200*a* of the upper mechanism 200 of the transfer device assembly A. The load of the patient moving from the roller assembly 234 along the pivot arm 200*c* while being carried by the belt 220 is substantially supported by the plate-like arm member 231. The load of the patient carried by the belt in the support 200*a* of the upper mechanism 200 is substantially supported by the back-up plates 219. In the transfer device 1, the height of the supports 100*a*, 200*a* of the lower mechanism 100 and the upper mechanism 200 is reduced, and the diameter of the roller assembly 234 is made relatively small. Therefore, the discomfort or fear the patient feels when he or she is transferred from the bed onto the transfer device 1 can be reduced. Further, as noted above, the belts 120 and 220, each of which has a slip-resistant outer surface and a slippery inner surface, turn around the rollers in the driving portions 100B and 200B, respectively, as shown in FIG. 2. Therefore, the resistance to traveling can be considerably suppressed while the driving force of the drive motors 112, 212 can be effectively transmitted. Thus, as noted above, the belts can travel relative to the bed surface 300 without slipping, and the patient can be placed on the support 200*a* without slipping. The above-described is the operation for placing the patient onto the support 200*a* of the upper mechanism 200 by slipping the transfer device 1 between the bed surface 300 and the patient. To transfer the patient from the support 200*a* of the upper mechanism 200 to the bed surface 300, the assembly is operated in the opposite manner. Specifically, in the state in which the patient is placed on the support 200*a*, the endless belts 120, 220 of the lower mechanism 100 and the upper mechanism 200 are operated in the direction of the arrow q. By this, the transfer device assembly A can move sideways from between the patient and the bed surface 300 without causing relative movement between the patient and the bed surface 300.

Further, by rotating the endless belt 120 of the lower mechanism 100 respectively in the opposite directions with the endless belt 220 of the upper mechanism 200 kept stationary, the transfer device assembly A can advance or retreat while carrying the patient.

In the transfer device assembly A, the drive housings 100*b*, 200*b* of the lower mechanism 100 and the upper mechanism 200 are arranged adjacent to each other in the back and forth direction, and the drive housings 100*b*, 200*b* are located at a portion offset toward one end of the assembly in the belt travel direction. Therefore, the drive housings 100*b*, 200*b* function as the support of the patient placed on the support 200*a* of the upper mechanism 100, whereby the patient can be stably held.

Figure 19:
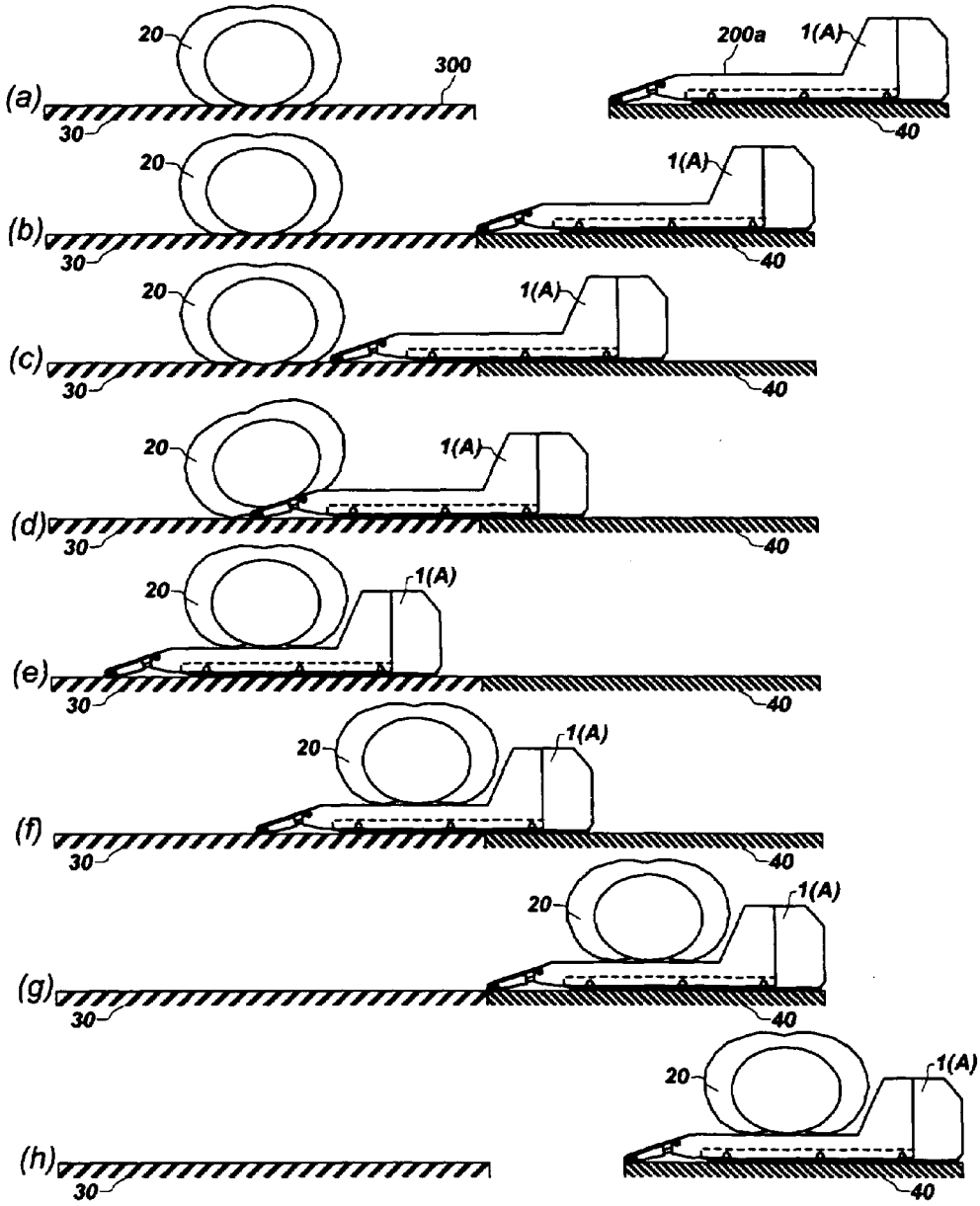
FIG. 19 shows an example of transferring manner using the transfer device assembly shown in FIG. 1.
Figure 20:
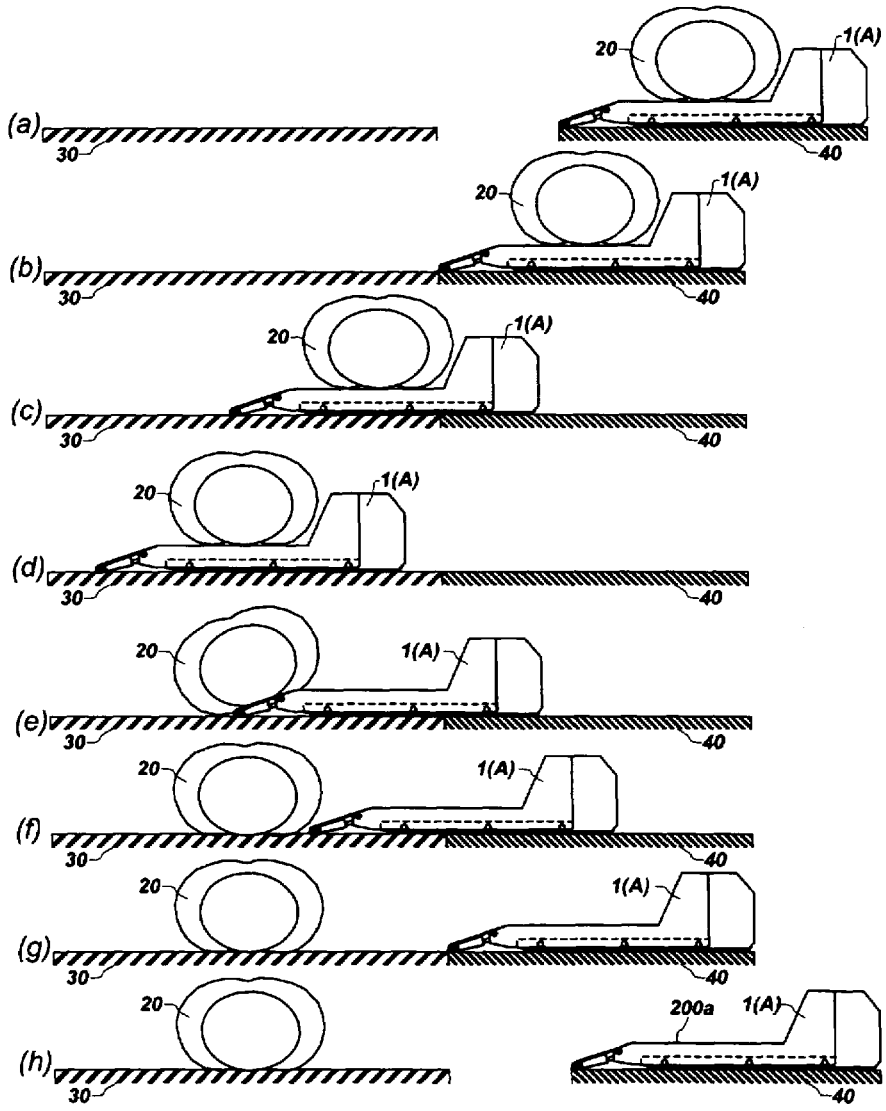
FIG. 20 shows an example of transferring manner using the transfer device assembly shown in FIG. 1.

Next, with reference to FIGS. 19 and 20, an example of manner for transferring e.g. a patient by the transfer device assembly A will be described in detail. FIG. 19 shows an example of transferring a patient 20 from a bed 30 in e.g. a hospital room as the pre-transfer position onto a stretcher 40, whereas FIG. 20 shows an example of transferring a patient 20 from the stretcher 40 onto a bed 30 in a treatment room such as an operation room as the transfer destination.

As shown in FIG. 19(*a*), the transfer device assembly A is placed on the stretcher 40. The transfer device assembly A is held on the stretcher 40 with the support 200*a* oriented toward the bed 30 as the pre-transfer position and fixed, in this state, to a side of the bed 30 by a non-illustrated engagement unit (FIG. 19(*b*)). The patient 20 is lying on the bed 30.

The transfer device assembly A is caused to perform "straight traveling". As a result, the transfer device assembly A travels from the stretcher 40 onto the bed 30 (FIG. 19(*c*)) to come close to the patient 20. When the patient 20 lies as inclined, the assembly performs "circular traveling" in either direction so that the front edge of the transfer device assembly A becomes substantially parallel to the patient.

Subsequently, the transfer device assembly A is caused to perform "straight traveling" by a predetermined distance while the endless belts 220 of the upper mechanisms 200 are rotated at the same speed but in the opposite direction from the endless belts 120 of the lower mechanisms 100. As a result, the patient 20 can be placed on the support 200*a* of the transfer device assembly A without causing relative movement between the patient 20 and the bed surface 300 (FIG. 19(*d*)(*e*)).

Subsequently, with the endless belts 220 of the upper mechanisms 200 kept stationary, the endless belts 120 of the lower mechanisms 100 are rotated in the opposite direction from the above, whereby the transfer device assembly A is caused to perform "straight traveling" in the retreating direction (FIG. 19(*f*)). When the patient 200 who has lay as inclined is placed, "circular traveling" is performed so that the transfer device assembly A becomes parallel with the length of the bed 30. As a result, with the patient 20 placed on the support 200*a*, the transfer device assembly A moves onto the stretcher 40 (FIG. 19(*g*)). When the transfer device assembly A is completely moved onto the stretcher 40, the engagement between the stretcher 40 and the bed 30 is released so that the stretcher 40 is moved to a predetermined place such as an operating room in a hospital or nursing facility (FIG. 19(*h*)).

When the patient has moved and inclined after the placement onto the support 200*a*, the belts 220 of the upper mechanisms 200 of the transfer devices 1 are operated individually to perform the above-described "patient-carried turning", whereby the posture of the patient is adjusted to become parallel with the edge of the transfer device assembly A.

As shown in FIG. 20(*a*) (*b*), the stretcher 40 on which the transfer device assembly A carrying the patient 20 on the support 200*a* is placed is set alongside and fixed to the bed 30 such as abed in an operating room as the transfer destination. In this case again, the transfer device assembly A is so set that the support 200*a* is oriented toward the bed 30 as the transfer destination.

With the endless belts 220 of the upper mechanisms 200 kept stationary, the transfer device assembly A is caused to perform "straight traveling" in the advancing direction and moves onto the bed 30 as the transfer destination (FIG. 20 (*c*)(*d*)).

Subsequently, the transfer device assembly A is caused to perform "straight traveling" in the retreating direction. At this time, the endless belts 220 of the upper mechanisms 200 are rotated at the same speed but in the opposite direction from the endless belts 120 of the lower mechanisms 100. As a result, the transfer device assembly A moves sideways to get out from between the patient 20 and the bed surface 300 (FIG. 20(*e*)(*f*)). At this time, as noted above, relative movement does not occur between the endless belts 220 of the upper mechanisms 200 and the bed surface 300, so that the patient 20 can be transferred from the support 200*a* onto the bed 30 as the transfer destination without feeling much discomfort.

The transfer device assembly A continues the "straight traveling" in the retreating direction and returned onto the stretcher 40 (FIG. 20(*g*)). After the transfer device assembly A is completely moved onto the stretcher 40, the engagement between the stretcher 40 and the bed 30 of the transfer destination is released, whereby the stretcher 40 and the transfer device assembly A placed thereon is removed from the bed 30 of the transfer destination (FIG. 20(*h*)).

When the bed 30 of the pre-transfer position or the transfer destination has a width corresponding to the length of the transfer device assembly A, the transfer device assembly may be turned around by performing the above-described "turning at a fixed position".

As noted above, the above operation of the transfer device assembly A is performed by the operation of the switches of the control box CB by a nurse or a care worker. As noted above, when part of the transfer device assembly A protrudes from the bed 30 or the stretcher 40, any one of the object detection sensors 130 outputs an OFF signal. In accordance with the signal, the central computer CC stops the operation of the lower mechanisms 100, whereby the transfer device assembly A is prevented from falling from the bed 30 or the stretcher 40.

Each of the transfer devices 1 of the transfer device assembly A incorporates the battery Ba. Therefore, when the patient transferred from the bed 30 of the pre-transfer position onto the stretcher 40 in a hospital room is moved to a treatment room such as an operating room and transferred onto the bed 30 as the transfer destination, an AC power source is not necessary. Therefore, the transferring operation can be performed quickly, and the transfer area can be greatly increased.

Figure 21:
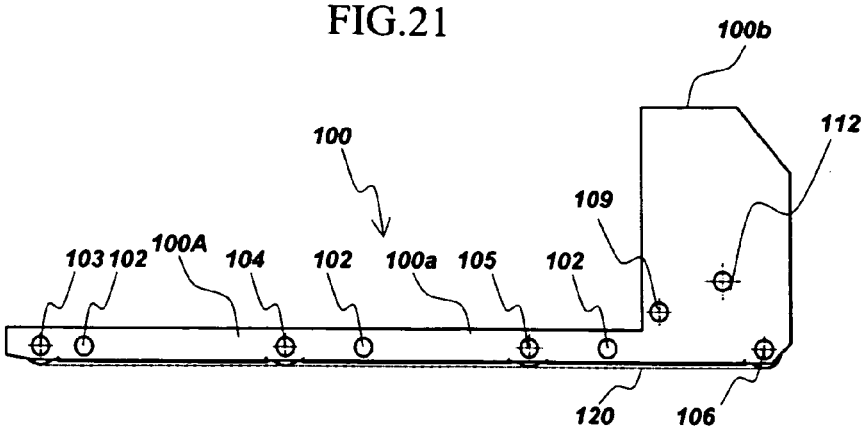
FIG. 21 is a side view showing another embodiment of the present invention.
Figure 22:
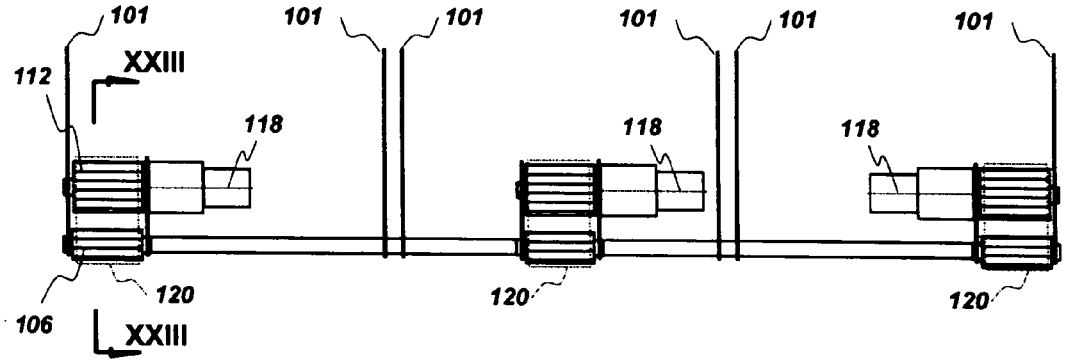
FIG. 22 schematically illustrates the rear surface of the lower mechanisms shown in FIG. 21.
Figure 23:
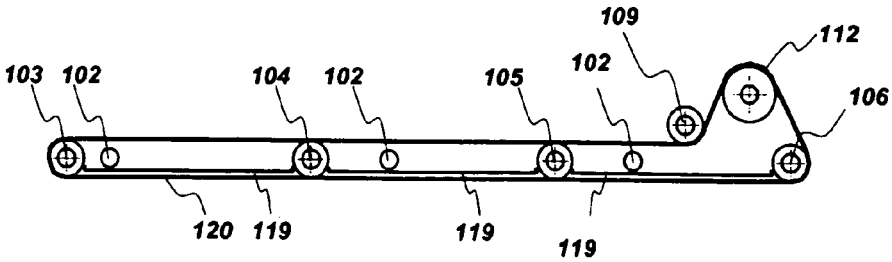
FIG. 23 is a sectional view taken along lines XXIII—XXIII in FIG. 22.

FIGS. 21–23 show a second embodiment of lower mechanism 100 of the transfer device assembly A according to the present invention.

The lower mechanism 100 of this embodiment differs from that of the first embodiment in the structure of the endless belt 120 and the driving portion 100B for rotating the belt. Specifically, in this embodiment, a timing belt (toothed belt) having a width which is smaller than that of the frame 100A is used as the endless belt 120 of the lower mechanism 100. The toothed surface (inner surface) of the timing belt 120 turns around the drive roller 112 in the driving portion 100B provided in the drive housing 100*b* of the frame 100A. In this case, slipping between the drive roller 112 and the timing belt 120 does not occur. Therefore, the fifth idle roller (tension roller) 107 and the sixth idle roller 108, which are provided in the first embodiment, can be eliminated. As shown in FIG. 22, among the three lower mechanisms 100, the endless belt 120, i.e. the timing belt in each of the left and the right lower mechanisms 100 is arranged at a portion which is offset widthwise toward an outer edge of the mechanism, whereas the endless belt in the center lower mechanism 100 is arranged at the widthwise center. Such arrangement makes it possible to perform the "circular traveling" and the "turning at a fixed position" properly. In this way, since the endless belt 120 is smaller in width than the frame 100A of each lower mechanism 100, the drive roller 112 can be directly driven by the motor 118 with a speed reducer. The other structures are similar to those of the first embodiment. Therefore, the elements or members which are similar to those of the first embodiment and designated by the same reference signs as those used for the first embodiment, and the description thereof is omitted. As the upper mechanism 200 to be combined with the lower mechanism, an upper mechanism which is similar to that of the first embodiment can be used.

As will be easily understood, in the second embodiment again, the same advantages as those described above as to the first embodiment can be obtained, and the transferring operation of the patient can be performed in a similar manner.

Of course, the scope of the present invention is not limited to the foregoing embodiments, and all the variations within the scope of each claim are included in the scope of the present invention.

The method of transferring a patient or the like is not limited to that described above with reference to FIGS. 19 and 20. Moreover, the transfer device or the transfer device assembly of the present invention can be used not only for the transfer of a patient in a hospital or a nursing facility but also for various purposes such as the transfer of an article such as wooden furniture which is likely to be damaged and needs to be transferred carefully.

The invention claimed is:

1. A transfer device comprising:

a lower mechanism including a first endless belt, a first support extending along a traveling path of the first endless belt, and a first driving unit for operating the first endless belt; and an upper mechanism including a second endless belt, a second support extending along a traveling path of the second endless belt, and a second driving unit for operating the second endless belt, the upper mechanism being stacked on the lower mechanism;

wherein the first endless belt and the second endless belt are operable independently of each other for forward and backward circulation;

wherein the first driving unit is disposed at one end of the first support in a traveling direction of the first endless belt, the second driving unit being disposed at one end of the second support in a traveling direction of the second endless belt; and wherein the first driving unit includes a first drive housing projecting upward from said one end of the first support, the second driving unit including a second drive housing projecting upward from said one end of the second support, the second support being placed over the first support with the second drive housing located adjacent to the first drive housing.

2. The transfer device according to claim 1, wherein the lower mechanism includes a first rectangular frame and a plurality of first rollers rotatably supported by the first frame, the first endless belt being guided in circulation by these first rollers, and wherein the upper mechanism includes a second rectangular frame and a plurality of second rollers rotatably supported by the second frame, the second endless belt being guided in circulation by these second rollers.

3. The transfer device according to claim 1, wherein the first support extends horizontally from the first drive housing, the first drive housing accommodating a first driving roller held in contact with the first endless belt, and wherein the second support extends horizontally from the second drive housing, the second drive housing accommodating a second driving roller held in contact with the second endless belt.

4. The transfer device according to claim 3, wherein each of the first endless belt and the second endless belt includes a smooth inner surface and an outer surface which is less smooth than the inner surface, the first driving roller being held in contact with the outer surface of the first endless belt, the second driving roller being held in contact with the outer surface of the second endless belt.

5. The transfer device according to claim 1, wherein the first driving unit is provided with a first tension roller held in contact with the first endless belt, the second driving unit being provided with a second tension roller held in contact with the second endless belt.

6. The transfer device according to claim 1, wherein each of the first endless belt and the second endless belt comprises a timing belt.

7. The transfer device according to claim 2, wherein the upper mechanism includes an arm extending beyond the lower mechanism, the arm having a front end provided with at least one belt-reversing roller for reversing a traveling direction of the second endless belt.

8. The transfer device according to claim 7, wherein the belt-reversing roller is disposed at a lower position than the first rollers.

9. The transfer device according to claim 7, wherein the arm is pivotable about a horizontal axis and constantly urged downward.

10. The transfer device according to claim 7, wherein the arm is provided with a sled covering a lower portion of the belt-reversing roller.

11. The transfer device according to claim 7, the front end of the arm is provided with a plurality of bracket pieces and a rod supported by the bracket pieces, the bracket pieces being horizontally spaced from each other, the rod rotatably supporting a plurality of belt-reversing rollers for reversing a traveling direction of the second endless belt.

12. The transfer device according to claim 1, wherein the upper mechanism is detachably attached to the lower mechanism.

13. A transfer device assembly comprising a plurality of transfer devices, wherein each of the transfer devices comprises a lower mechanism including a first endless belt and a first driving unit for operating the first endless belt; and an upper mechanism including a second endless belt and a second driving unit for operating the second endless belt, the upper mechanism being stacked on the lower mechanism;

wherein the first endless belt and the second endless belt are operable independently of each other for forward and backward circulation; and wherein the first driving unit is disposed at one end of the lower mechanism as viewed in a traveling direction of the first endless belt, the second driving unit being disposed at one end of the upper mechanism as viewed in a traveling direction of the second endless belt;

wherein the plurality of transfer devices are connected to each other in a widthwise direction, the first endless belts of the respective transfer devices being operable independently of each other for forward and backward circulation;

wherein each of the first driving units and the second driving units of the respective transfer devices is provided with a driving roller held in contact with the endless belt, a motor for rotating the driving roller, a motor driver for operating the motor, and an individual computer for controlling the motor driver, the individual computer being controlled by a central computer.

14. The assembly according to claim 13, wherein the lower mechanisms of the respective transfer devices are connected to each other for providing a lower mechanism assembly to which each of the upper mechanisms is detachably attached.

15. The assembly according to claim 13, wherein each of the transfer devices is provided with a power supply battery.

16. The assembly according to claim 13, wherein at least one of the transfer devices is provided with a sensor for detecting an object below the sensor, the sensor outputting a signal used as a control input signal by the central computer.

17. The assembly according to claim 13, wherein at least one of the transfer devices is provided with a speaker controlled by the central computer, the speaker providing audio information about operating conditions of the assembly or instructions for a human operator.

18. A transfer device comprising:

a lower mechanism including a first endless belt and a first driving unit for operating the first endless belt; and an upper mechanism including a second endless belt and a second driving unit for operating the second endless belt, the upper mechanism being stacked on the lower mechanism;

wherein the first endless belt and the second endless belt are operable independently of each other for forward and backward circulation;

wherein the first driving unit is disposed at one end of the lower mechanism as viewed in a traveling direction of the first endless belt, the second driving unit being disposed at one end of the upper mechanism as view in a traveling direction of the second endless belt; and wherein the first driving unit is provided with a first tension roller held in contact with the first endless belt, the second driving unit being provided with a second tension roller held in contact with the second endless belt.

19. A transfer device comprising:

a lower mechanism including a first endless belt and a first driving unit for operating the first endless belt; and an upper mechanism including a second endless belt and a second driving unit for operating the second endless belt, the upper mechanism being stacked on the lower mechanism;

wherein the first endless belt and the second endless belt are operable independently of each other for forward and backward circulation;

wherein the first driving unit is disposed at one end of the lower mechanism as viewed in a traveling direction of the first endless belt, the second driving unit being disposed at one end of the upper mechanism as viewed in a traveling direction of the second endless belt; and wherein the upper mechanism includes an arm extending beyond the lower mechanism, the arm having a front end provided with at least one belt-reversing roller for reversing a traveling direction of the second endless belt.

20. A transfer device comprising:

a lower mechanism including a first endless belt and a first driving unit for operating the first endless belt; and an upper mechanism including a second endless belt and a second driving unit for operating the second endless belt, the upper mechanism being stacked on the lower mechanism;

wherein the first endless belt and the second endless belt are operable independently of each other for forward and backward circulation;

wherein the first driving unit is disposed at one end of the lower mechanism as viewed in a traveling direction of the first endless belt, the second driving unit being disposed at one end of the upper mechanism as viewed in a traveling direction of the second endless belt;

wherein the upper mechanism extends beyond the lower mechanism and having a front end provided with at least one belt-reversing roller for reversing a traveling direction of the second endless belt; and wherein the belt-reversing roller has a lower portion covered by a sled.

21. A transfer device assembly comprising a plurality of lower endless belts, and a plurality of upper endless belts, each of the lower and upper endless belts being circulatable in forward and reverse directions, each of the lower and upper endless belts having a first dimension extending in the circulating directions and a second dimension extending in a direction perpendicular to the circulating directions, the plurality of lower endless belts being arranged in a row extending in said perpendicular direction, the plurality of upper endless belts being also arranged in a row extending in said perpendicular direction and stacked on the plurality of lower endless belts, wherein the first dimension is larger than the second dimension with respect to all of the lower and upper endless belts.

22. The transfer device assembly according to claim 21, wherein all of the lower and upper endless belts are driven independently of one another by respective driving units.

23. A transfer device assembly comprising a plurality of transfer devices linking with each other, each of the transfer devices including an upper mechanism and a lower mechanism associated with the upper mechanism, wherein the upper mechanism includes a first endless belt that circulates in forward and reverse directions, the lower mechanism including a second endless belt that circulated in forward and reverse directions independently of the first endless belt, wherein each of the transfer devices is elongate in the circulating directions of the first and second endless belts, and wherein the plurality of transfer devices are arrayed widthwise in a row extending perpendicularly to the circulating directions of the first and second endless belts.

* * * * *